US009926695B2

(12) United States Patent
Lehmann et al.

(10) Patent No.: US 9,926,695 B2
(45) Date of Patent: Mar. 27, 2018

(54) TOILET CLEANER WITH VARIABLE PRODUCT DISPENSION

(71) Applicant: Henkel AG & Co. KGaA, Duesseldorf (DE)

(72) Inventors: Detlef Lehmann, Erkrath-Hochdahl (DE); Hans-Georg Muehlhausen, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 213 days.

(21) Appl. No.: 14/627,132

(22) Filed: Feb. 20, 2015

(65) Prior Publication Data

US 2015/0167282 A1 Jun. 18, 2015

Related U.S. Application Data

(63) Continuation of application No. PCT/EP2013/054314, filed on Mar. 5, 2013.

(30) Foreign Application Priority Data

Aug. 22, 2012 (DE) ..... 10 2012 214 898

(51) Int. Cl.
*E03D 9/03* (2006.01)
*E03D 9/02* (2006.01)

(52) U.S. Cl.
CPC ..... *E03D 9/032* (2013.01); *E03D 2009/024* (2013.01); *E03D 2009/026* (2013.01)

(58) Field of Classification Search
CPC ..... E03D 9/032
USPC ..... 4/231
See application file for complete search history.

(56) References Cited

U.S. PATENT DOCUMENTS

| | | | |
|---|---|---|---|
| 1,067,472 | A | 7/1913 | Creed |
| 4,615,054 | A | 10/1986 | Buecheler et al. |
| 2004/0068782 | A1 | 4/2004 | Butter-Jentsch et al. |
| 2004/0107484 | A1 | 6/2004 | Butter-Jentsch et al. |
| 2012/0047640 | A1 | 3/2012 | Warkotsch et al. |

FOREIGN PATENT DOCUMENTS

| | | | |
|---|---|---|---|
| DE | 7332236 | U | 11/1973 |
| DE | 8001994 | U1 | 5/1980 |
| DE | 3424317 | A1 | 1/1986 |
| DE | 19520145 | A1 | 12/1996 |
| WO | 2008/120543 | A1 | 10/2008 |

OTHER PUBLICATIONS

PCT International Search Report (PCT/EP2013/054314) dated May 31, 2013.

*Primary Examiner* — Tuan N Nguyen
(74) *Attorney, Agent, or Firm* — P. Scott Smith

(57) ABSTRACT

The invention relates to a toilet cleaner for receiving solid or gel preparations, comprising a plurality of containers for receiving at least one preparation. The containers can be positioned below the toilet rim such that flushing water can flow over the containers when the toilet is flushed, and at least one inlet opening and outlet opening are formed in each container wall for the flushing water. A flushing water conducting element is arranged and configured on the toilet cleaner such that flushing water is supplied to the flushing water conducting element when the toilet is flushed and the flushing water is conducted to the inlet opening of the container. The inlet openings are asymmetrical relative to the vertical axis V of the containers and are arranged at an angle of incidence α of 1°-60° relative to the longitudinal central axis M.

2 Claims, 3 Drawing Sheets

TOILET CLEANER WITH VARIABLE PRODUCT DISPENSION

FIELD OF THE INVENTION

The present invention generally relates to a toilet rim basket for the reception of solid or gelled preparations.

BACKGROUND OF THE INVENTION

It is known, for automatic cleaning of toilet bowls, to attach active-agent preparations in lump form, in a cage-like container, to the inner rim of the toilet bowl. At each flushing operation a portion of the active agent dissolves in the flushing water and is distributed in the bowl together with the water.

The active-agent preparations used are such that on the one hand they can be shaped into dimensionally stable, non-deliquescent blocks, and on the other hand they possess sufficient solubility that a sufficient quantity of active agents is delivered to the water during the brief flushing phase. It is also important that the active-agent block remain unmodified, except for a delivery of scent, after the flushing operation.

DE 34 24 317 A1 contains an example of an active-agent preparation of this kind. The preparation contains anionic and nonionic surfactants, perfume, cellulose powder, rinse-off regulators, inorganic salts, complexing agents, lime-dissolving acids, antimicrobial active agents, plasticizers, and further usual additives.

Single-use toilet rim baskets, which must be disposed of once the active-agent block dissolves completely, are known. Refillable toilet rim blocks, two of which are described in DE 80 01 994 U1 and DE 34 23 758 A1, are likewise known and are more favorable in environmental terms.

The known toilet rim baskets for the reception of lump-form toilet cleaning blocks are ordinarily not usable for pastes or liquid. This is because the paste or liquid must not spontaneously flow or drip out of the rim basket once the flushing operation is complete. In addition, only a defined fraction of the liquid or paste is to be delivered at each flushing operation. This delivered fraction of the active-agent preparation is to be as identical as possible for each flushing operation. Toilet rim baskets of this kind for pasty or liquid preparations are known, for example, from DE 19520145A1 or from EP 1334239B1.

Also known in the existing art are multi-chamber receptacles for the active-agent preparations described above, which are suspended in the toilet bowl in such a way that when the toilet bowl is flushed with water, a delivery of active agent from the toilet rim bowl into the toilet bowl occurs. Depending on the position of the toilet bowl bask on the rim of the toilet bowl, inhomogeneous emptying of the chambers can occur as a result of the inhomogeneous flow conditions inside the flow of flushing water.

A substantial disadvantage of all these toilet rim baskets is that the release of active agent cannot be controlled by the user. A need routinely exists, however, for the user to be able to influence in simple fashion the quantity of active agents, and thus the intensity of the cleaning or scenting performance of a toilet rim bowl.

The object of the present invention is therefore to eliminate the disadvantages presented, and to provide a toilet rim basket in which the quantity of active agents, and thus the intensity of the cleaning or scenting performance of a toilet rim basket, can easily be influenced by a user.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A toilet rim basket (1) for the reception of solid or gelled preparations, comprising a plurality of containers (3*a*, 3*b*, 3*c*, 3*d*), arranged in series with one another based on the longitudinal center axis M of the toilet rim basket, for the reception of at least one preparation (4*a*, 4*b*, 4*c*, 4*d*), wherein the containers (3*a*, 3*b*, 3*c*, 3*d*) are positionable below the toilet rim (10) in such a way that flushing water can flow over them upon flushing of the toilet (9), and at least one inlet opening (5*a*, 5*b*, 5*c*, 5*d*) and one outlet opening (6*a*, 6*b*, 6*c*, 6*d*) for the flushing water is respectively shaped in the container wall (7); and a holder (2) for mounting the toilet rim basket (1) on the toilet rim (10), wherein a flushing water directing element (8) is arranged and configured on the toilet rim basket (1) in such a way that the flushing water directing element (8) is impinged upon by flushing water upon flushing, and a delivery of flushing water to the inlet opening (5*a*, 5*b*, 5*c*, 5*d*) of the container (3*a*, 3*b*, 3*c*, 3*d*) is caused, characterized in that the inlet openings (5*a*, 5*b*, 5*c*, 5*d*) are arranged asymmetrically with regard to the vertical axis V of the containers (3*a*, 3*b*, 3*c*, 3*d*); and are arranged at an inclination angle a with respect to the longitudinal center axis M from 1° to 60°, preferably 5° to 45°, particularly preferably 10° to 30°.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
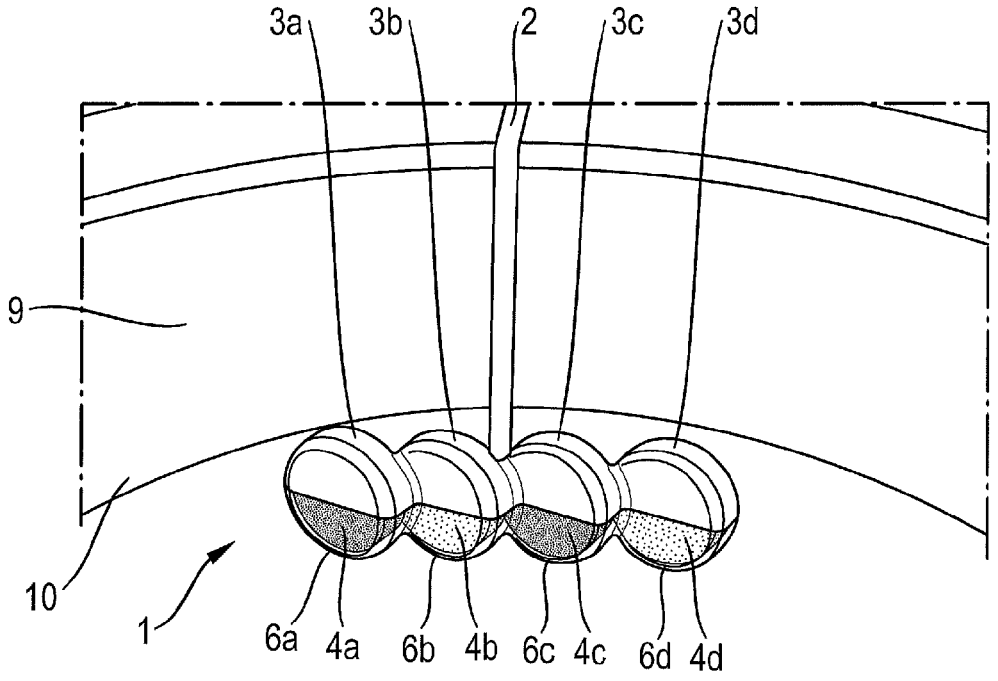
FIG. 1 shows a toilet rim basket in the state positioned in the toilet bowl.

The following detailed description of the invention is merely exemplary in nature and is not intended to limit the invention or the application and uses of the invention. Furthermore, there is no intention to be bound by any theory presented in the preceding background of the invention or the following detailed description of the invention.

The toilet rim basket according to the present invention for the reception of solid or gelled preparations comprises a plurality of containers, arranged in series with one another based on the longitudinal center axis M of the toilet rim basket, for the reception of at least one preparation, wherein the containers are positionable below the toilet rim in such a way that flushing water can flow over them upon flushing of the toilet, and at least one inlet opening and one outlet opening for the flushing water is respectively shaped in the container wall; a holder for mounting the toilet rim basket on the toilet rim, wherein a flushing water directing element is arranged and configured on the toilet rim basket in such a way that the flushing water directing element is impinged upon by flushing water upon flushing, and a delivery of flushing water to the inlet opening of the container is caused, wherein the inlet openings are arranged asymmetrically with regard to the vertical axis V of the containers, and are arranged at an inclination angle a with respect to the longitudinal center axis M from 1° to 60°, preferably 5° to 45°, particularly preferably 10° to 30°.

As a result of the asymmetrical arrangement according to the present invention of the flushing water inlet openings, as well as the angled inclination of the containers of the toilet rim basket, two different active-agent delivery quantities from the toilet bowl cleaner can be realized, by the fact that the toilet bowl cleaner is simply positioned by the user on oppositely located sides of the toilet bowl. This is further explained below.

Container

A "container" is understood as a packaging means that is suitable for at least partly encasing and/or holding together a solid, liquid, or gelled preparation.

The toilet rim basket according to the present invention is made of a plurality of containers, wherein the latter are arranged next to one another, preferably on a line.

It is furthermore preferred that more than one container for reception of a preparation or of preparations differing from one another be provided on the toilet rim basket. In particular, preparations that are not mutually shelf-stable can thereby be stored physically separately from one another. It is also possible in principle, however, in particular with solid preparations, to position preparations that differ from one another alongside one another in one container.

It is advantageous in this connection to embody the container so as to prevent an exchange, between the containers, of flushing water that has entered.

In the context of a plurality of containers, they can be connected integrally to one another. This has the advantage in particular that the containers can be shaped integrally, for example using an injection molding process, and subsequent joining of individual contains is superfluous. With this kind of configuration of the containers, it is furthermore advantageous to embody the containers as half-shells that are connected to one another by a material bridge. The material bridge serves as a hinge around which the half-shells can be tilted and can be joined to one or to a plurality of containers.

In an embodiment of the invention, the containers can be connected to one another via a non-water-conveying web. This allows, in particular, the embodiment of dimensionally stable containers that provide sufficient mechanical protection for the preparations stored in them, wherein an elastic connection between the containers can be embodied by means of the web so that in the inserted state, the toilet rim basket follows the contour of the toilet bowl.

For solid and gelled preparations in particular, the container is embodied so that flushing water can flow through it. i.e. it comprises at least one inlet opening for the entry of flushing water into the container, and at least one outlet opening for the exit, from the container, of flushing water charged with preparation.

In an advantageous embodiment of the toilet rim basket according to the present invention, the inlet opening of the container or containers is located, with the toilet rim basket in the installed state, outside the flushing water flow. In other words, without the use of a flushing water directing element, no flushing water, or at least only a very small quantity thereof, enters the container through the inlet opening(s).

It is also advantageous to embody the inlet opening(s) in slit-shaped fashion parallel to the longitudinal axis of the toilet rim basket.

Preparations

Solid preparations, which are also usually referred to as "toilet blocks," are manufactured predominantly as pressed shaped elements, as extrudates, or using casting methods. It is also conceivable to configure shaped elements of this kind at least in part from a gelled or liquid phase. For example, the core of a toilet block can be made of a gel that is secured, for example by adhesive bonding, in a cavity of the toilet block.

Toilet blocks nowadays usually have a cylindrical or bar-like shape. It is conceivable and desirable, however, to provide shapes that are differentiated from these traditional shapes, so that greater distinctiveness for a corresponding product among consumers can be achieved. The solid preparations can therefore in particular be of spherical or cylindrical configuration.

Preparations for a toilet rim basket according to the present invention usually contain substances such as cleaning substances, enzymes, perfume oils, dyes, surfactants, or foaming agents. The perfume oils, dyes, and surfactants can in particular be natural ones. The preparation preferably has a surfactant content from 2 to 50 wt % and/or a perfume oil content from 1 to 20 wt % and/or a dye content from 0.5 to 20 wt %. In a particularly preferred embodiment the preparation comprises at least one enzyme at a concentration from 0.1 to 10 wt %.

It is particularly preferred that a toilet block comprise at least one first water-soluble basic element as well as at least one external water-soluble layer at least partly covering the basic element. It is very particularly preferred if the outer layer has optical properties, for example a color and/or gloss, different from the basic element. It is thereby possible to provide for the user an indicator function that indicates, after a few flushing cycles, how uniformly water is flowing over and impinging upon the respective toilet blocks in the toilet rim basket, so that the toilet bowl dispenser can possibly be differently positioned in the toilet bowl.

The outer layer of the toilet block preferably has a thickness of between 10 and 1000 μm, particularly preferably 20 to 500 μm, very particularly preferably 50 to 150 μm. Preferably the layer completely surrounds the basic element.

Preferred toilet blocks are furthermore characterized in that the basic element is a granulate and/or an extrudate and/or a pellet and/or a prill and/or a melt-cast shaped element and/or a tablet.

Holder

The toilet rim basket according to the present invention comprises a holder for securing the toilet rim basket on the rim of a toilet bowl.

Such holders are usually embodied as a rod-shaped element having two loops, so that the holder having the toilet rim basket can be clamped against the rim of the toilet thanks to the spring action of the loops.

In an advantageous refinement of the invention, the holder comprises at least one spring element that, with the toilet bowl dispenser in the state installed in the toilet, has a substantially vertical or horizontal spring travel. It is furthermore very particularly preferred that the holder comprise at least two spring elements, wherein with the toilet bowl dispenser in the state installed in the toilet, one spring element has a substantially vertical spring travel and one spring element has a substantially horizontal spring travel. The spring travel that is provided enables improved and more flexible securing of the toilet rim basket onto toilets having different bowl rim thicknesses and configurations. The spring element can in particular be of rhomboidal configuration.

Figure 2:
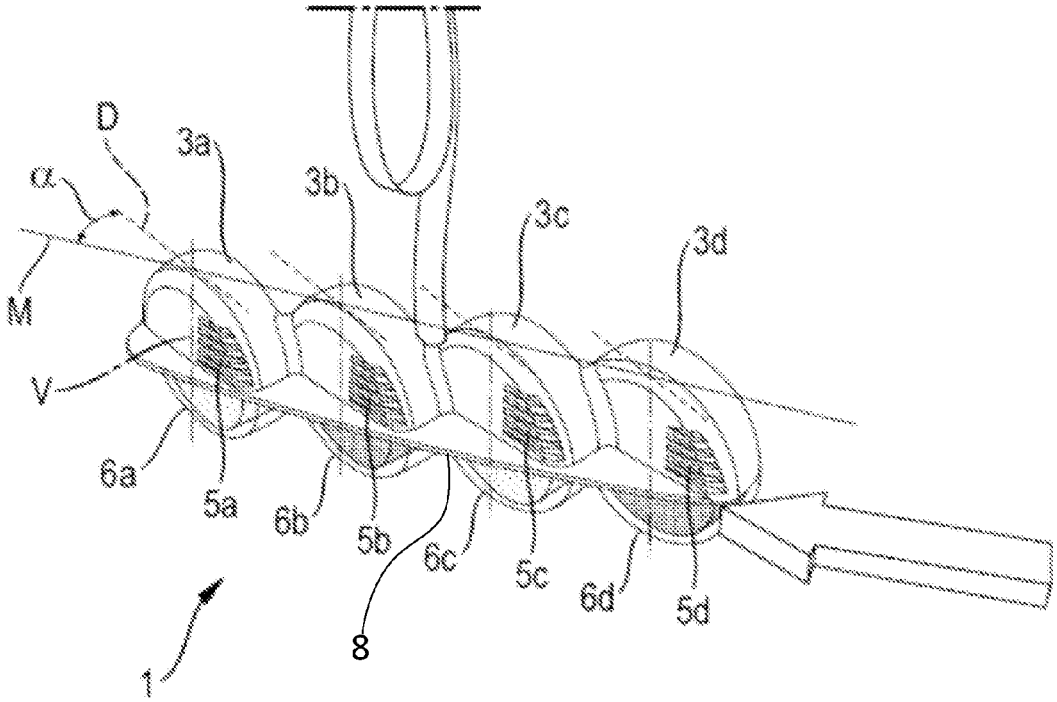
FIG. 2 is a perspective view of a toilet rim basket.

The invention will be further explained by way of example with reference to the following Figures, in which:

FIG. 1 shows a toilet rim basket in the state positioned in the toilet bowl;

FIG. 2 is a perspective view of a toilet rim basket; and

Figure 3:
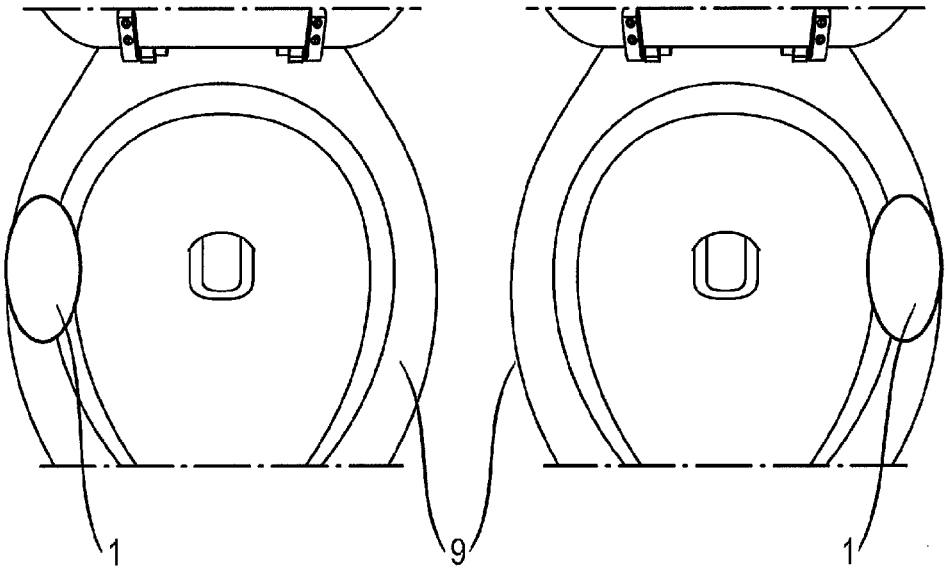
FIG. 3 is a plan view of a toilet rim basket in different states positioned in the toilet bowl.

FIG. 3 is a plan view of a toilet rim basket in different states positioned in the toilet bowl.

FIG. 1 shows an embodiment of toilet rim basket 1 according to the present invention in the state suspended in toilet bowl 9, wherein toilet rim basket 1 is secured releasably on toilet bowl 9 by means of holder 2.

Toilet rim basket 1 is made of four containers 3*a*, 3*b*, 3*c*, 3*d* arranged in a row, which are of cylindrical configuration and which each store a solid toilet cleaning composition 4*a*, 4*b*, 4*c*, 4*d*. Outlet openings 6*a*, 6*b*, 6*c*, 6*d* of containers 3*a*, 3*b*, 3*c*, 3*d* are arranged on that side of toilet rim basket 1 which faces away from toilet bowl 9.

Toilet rim basket 1 is configured so that in the state suspended in toilet bowl 9, flushing water directing element 8 (not visible) is arranged below toilet rim 10.

FIG. 2 shows toilet rim basket 1 known from FIG. 1 in a perspective view directed toward the toilet bowl, in the state suspended in toilet 9.

Containers 3*a*, 3*b*, 3*c*, 3*d* are of cylindrical configuration, wherein their rotation axis is arranged perpendicular to vertical axis V. Containers 3*a*, 3*b*, 3*c*, 3*d* are arranged linearly next to one another.

Flushing water directing element 8 is arranged approximately horizontally centeredly on the cylindrical containers 3*a*, 3*b*, 3*c*, 3*d* over the entire length of toilet rim basket 1. Flushing water directing element 8 is of plate-like configuration. Provided above flushing water directing element 8 in containers 3*a*, 3*b*, 3*c*, 3*d* are inlet openings 5*a*, 5*b*, 5*c*, 5*d* for flushing water that is delivered through flushing water directing element 8 to inlet openings 5*a*, 5*b*, 5*c*, 5*d*.

Inlet openings 5*a*, 5*b*, 5*c*, 5*d* are arranged on containers 3*a*, 3*b*, 3*c*, 3*d* asymmetrically with respect to vertical axis V. Containers 3*a*, 3*b*, 3*c*, 3*d* are furthermore arranged with the respective inlet openings 5*a*, 5*b*, 5*c*, 5*d* at a inclination angle a with respect to longitudinal center axis M from 1° to 60°, preferably 5° to 45°, particularly preferably 10° to 30°. Inlet openings 5*a*, 5*b*, 5*c*, 5*d* are slit-shaped, embodied parallel to flushing water directing element 8.

Upon actuation of the toilet flushing system, flushing water, which is usually flushed with a directed swirl into the toilet bowl, encounters toilet bowl dispenser 1 with a flow direction component that extends parallel to flushing water directing element 8. In the example of FIG. 2 that is shown, this is indicated by the arrow.

Because of the asymmetrical arrangement of inlet openings 5*a*, 5*b*, 5*c*, 5*d* and the inclined orientation of containers 3*a*, 3*b*, 3*c*, 3*d*, a different quantity of flushing water travels into inlet openings 5*a*, 5*b*, 5*c*, 5*d* depending on the direction from which the flushing water strikes toilet bowl dispenser 1. The impingement of flushing water onto containers 3*a*, 3*b*, 3*c*, 3*d* in a manner dependent on the flushing water direction also results in a different degree of active-agent release from the toilet bowl dispenser.

This manner of operation is explained further with reference to FIG. 3. FIG. 3 shows two different securing positions of toilet rim bowl 1 according to the present invention in a toilet bowl 9, which positions are typically selected by the user for securing toilet rim basket 1 on toilet bowl 9.

If toilet rim basket 1 known from FIG. 2 is fastened on the left side of toilet rim 9 as shown in the left illustration of FIG. 3, comparatively small quantities of flushing water then penetrate into toilet rim basket 1 if the flushing water flow exhibits a swirling motion in the direction of the arrow shown in FIG. 2, since because of the inclination of containers 3*a*, 3*b*, 3*c*, 3*d*, the flushing water flow proceeds largely parallel to the slit-shaped inlet openings 5*a*, 5*b*, 5*c*, 5*d*. If, on the contrary, toilet rim basket 1 is secured on the right side of toilet bowl 9, as shown in the right illustration of FIG. 3, the flushing water flow then encounters toilet rim basket 1 not in the direction shown in FIG. 2 but in exactly the opposite direction. In this case the inclination of containers 3*a*, 3*b*, 3*c*, 3*d* as well as the asymmetrical configuration of inlet openings 5*a*, 5*b*, 5*c*, 5*d* causes the flushing water flow to be conveyed directly into inlet openings 5*a*, 5*b*, 5*c*, 5*d*, with the result that comparatively large quantities of flushing water can enter the toilet rim basket. This variation of position on a toilet, easily performed by the user, thus allows the user to control, with the toilet rim basket according to the present invention, the degree of product release from the toilet bowl dispenser.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A toilet rim basket (1) for the reception of solid or gelled preparations, comprising a plurality of containers (3*a*, 3*b*, 3*c*, 3*d*), arranged in series with one another based on the longitudinal center axis (M) of the toilet rim basket, for the reception of at least one preparation (4*a*, 4*b*, 4*c*, 4*d*), wherein the containers (3*a*, 3*b*, 3*c*, 3*d*) are positionable below the toilet rim (10) in such a way that flushing water can flow over them upon flushing of the toilet (9), and at least one inlet opening (5*a*, 5*b*, 5*c*, 5*d*) and one outlet opening (6*a*, 6*b*, 6*c*, 6*d*) for the flushing water is respectively shaped in the container wall (7), a holder (2) for mounting the toilet rim basket (1) on the toilet rim (10), wherein a flushing water directing element (8) is arranged and configured on the toilet rim basket (1) in such a way that the flushing water directing element (8) is impinged upon by flushing water upon flushing, and a delivery of flushing water to the inlet opening (5*a*, 5*b*, 5*c*, 5*d*) of the container (3*a*, 3*b*, 3*c*, 3*d*) is caused, wherein each of the inlet openings (5*a*, 5*b*, 5*c*, 5*d*) are arranged asymmetrically on each container with regard to a plane V, said plane V encompassing the vertical axis (V) of a respective container and being perpendicular to a plane formed by vertical axis (V) of said respective container and longitudinal axis (M), and are arranged at an inclination angle ($\alpha$) with respect to the longitudinal center axis (M) from 1° to 60° wherein the containers (3*a*, 3*b*, 3*c*, 3*d*) are of cylindrical configuration and are arranged linearly next to one another along axis (M).

2. The toilet rim basket (1) according to claim 1 wherein the inlet openings (5*a*, 5*b*, 5*c*, 5*d*) are of slit-shaped configuration parallel to the flushing water directing element (8).

* * * * *